United States Patent [19]

Oyama et al.

[11] Patent Number: 4,779,179

[45] Date of Patent: Oct. 18, 1988

[54] COMPOSITE REFLECTING MIRROR FOR HEADLAMP

[75] Inventors: Hiroo Oyama, Sagamihara; Kouichi Masuyama, Tokyo, both of Japan

[73] Assignee: Stanley Electric Co., Ltd., Tokyo, Japan

[21] Appl. No.: 892,504

[22] Filed: Aug. 1, 1986

[30] Foreign Application Priority Data

Aug. 10, 1985 [JP] Japan ..... 60-176562

[51] Int. Cl.[4] ..... F21V 7/00

[52] U.S. Cl. ..... 362/346; 362/310; 362/348

[58] Field of Search ..... 362/346, 348–350, 362/341, 342, 80, 297, 309, 310

[56] References Cited

U.S. PATENT DOCUMENTS

| | | | |
|---|---|---|---|
| Re. 17,825 | 10/1930 | Linton et al. | 362/346 |
| 1,504,017 | 8/1924 | Bailey | 362/348 |
| 1,513,844 | 11/1924 | Michel | 362/348 |
| 1,568,505 | 1/1926 | Fishleigh | 362/309 |
| 1,621,585 | 3/1927 | Godley | 362/348 |
| 2,174,937 | 10/1939 | Dietz | 362/346 |
| 3,688,149 | 8/1972 | Pitkjaan | 362/346 |
| 4,143,412 | 3/1979 | Sassmannshausen | 362/346 |
| 4,149,229 | 4/1979 | Draper | 362/346 |
| 4,225,903 | 9/1980 | Buchleitner | 362/346 |
| 4,277,821 | 7/1981 | Sassmannshausen | 362/346 |
| 4,351,018 | 9/1982 | Fratty | 362/310 |
| 4,446,511 | 5/1984 | Sands | 362/310 |

FOREIGN PATENT DOCUMENTS 58-145002 8/1983 Japan .

*Primary Examiner*—Samuel Scott
*Assistant Examiner*—Noah Kamen
*Attorney, Agent, or Firm*—Frishauf, Holtz, Goodman & Woodward

[57] ABSTRACT

A composite reflecting mirror for a headlamp comprises a plurality of paraboloidal columnar reflecting surfaces, the reflecting surfaces having their respective focal points fall on a horizontal line extending through approximately the axis of symmetry of the mirror. The composite reflecting mirror is laterally substantially divided into three portions, i.e., a left end portion, a right end portion and a central portion. The relationship of the average value of the focal lengths of the plurality of paraboloidal columnar reflecting surfaces included in the respective portions is such that the average value of the focal lengths of the left end portion is greater than that of the central portion, and the average value of the focal lengths of the right end portion is greater than that of the central portion.

11 Claims, 7 Drawing Sheets

COMPOSITE REFLECTING MIRROR FOR HEADLAMP

BACKGROUND OF THE INVENTION (1) Field of the Invention

The present invention relates to a paraboloidal reflecting mirror for a headlamp mounted on and used for vehicles such as automobiles, and particularly to a composite reflecting mirror having a plurality of reflecting surfaces.

(2) Description of the Prior Art

In a headlamp for an automobile, radiant diverging light rays emitted by a light source are reflected by a paraboloidal reflecting mirror to illuminate the road ahead, and the light rays may be adjusted in direction by a group of cuts of a front lens to obtain the desired distribution of rays. The correction of the direction of the light rays by the group of cuts of the front lens employs the principle of a prism. Particularly, in order to spread light to the left and right, a cylindrical cut that may be regarded as a continuous prism (a cut portion is in the form of a cylindrical concave curved surface) is effectively used. A lens piece a of the cut portion is shown in FIG. 17. In this lens piece a, a cylindrical cut b is formed in the inner surface, and parallel reflecting luminous fluxes c reflected by the paraboloidal reflecting mirror are spread to left and right when they pass to the outside through the cylindrical cut b. Recently the air resistance of the vehicle has been taken up as a problem, and a headlamp having a large inclination angle $\theta$ of the front lens which is subjected to air pressure has been required. If the lens piece a is inclined at a fixed angle ($\theta \geqq 20°$), there occurs a phenomenon that the luminous fluxes projected on a screen d hang at the end from a horizontal line e (hereinafter referred to as the hanging phenomenon of the down-light), which is the characteristic of the cylindrical cut, thereby failing to provide a proper distribution of rays. Therefore, a large inclination angle may not be used. Accordingly, the spreading of the luminous fluxes by the cylindrical cuts of the front lens is of limited value.

A reflecting mirror for spreading luminous fluxes in a horizontal direction is well known as disclosed, for example, in Japanese patent publication No. 58-145002. (See FIG. 18, a front view, and FIG. 19, a sectional view.)

According to this well known reflecting mirror 10 (FIGS. 18 and 19), when a light source is placed in the vicinity of a focal point of a paraboloidal columnar reflecting mirror, the reflected rays are spread to the left and right, as shown in FIG. 20, and reflected light rays which are not substantially spread vertically are obtained. This is a flux distribution pattern formed when no lens is provided in front of the reflecting mirror. As will be apparent from this flux distribution pattern, the angle of spreading to the left and right is within 20°, and no hanging phenomenon occurs.

In the case of a headlamp for an automobile, a "pass-each other flux distribution", designed for the situation in which automobiles pass each other head on, is particularly important, and it is desirable that the light be spread to the left and right at an angle which is ±15° in terms of a standard, and substantially ±30°. Accordingly, in the well known reflecting mirror, in order to obtain the practical pass-each other flux distribution during use, the fluxes are corrected by the lens cut by way of the front lens 11 to form a proper pass-each other flux distribution or there is required a groove having a wide horizontal width as clearly described in the aforesaid Japanese patent publication No. 58-14502. It has been found however that the widening of the horizontal width of the groove inevitably reduces the number of reflecting portions, and as the result, the remote illuminance (which is the position at which the maximum illuminance is required in view of the flux distribution characteristic) is considerably reduced, thus failing to form a headlamp which can perform satisfactorily. This phenomenon possibly results from the system wherein reflected rays by grooves are superposed as the distribution of fluxes which are approximately symmetrical to the left and right about the front surface, that is, a curve wherein each focal distance F of a paraboloidal column contacts a tangent line at each apex thereof is made to comprise the same paraboloidal line as the focal distance F, whereby the flux distribution characteristic does not provide the so-called core.

SUMMARY OF THE INVENTION

The objects of the present invention are to overcome a problem of a luminous flux correction of a flux distribution pattern at a front lens, and a problem of a hanging phenomenon of light observed when the front lens is obliquely mounted, which have been encountered in prior art.

In order to solve the problems noted above with respect to the prior art, the present invention specifically provides a composite reflecting mirror for a headlamp comprising a plurality of paraboloidal columnar reflecting surfaces, the respective reflecting surfaces having their focal point on a center line along an approximately horizontal axis. The reflecting mirror is laterally substantially divided into at least a left end portion, a right end portion and a central portion. The relationship of the average value of the focal distances of the plurality of paraboloidal columnar reflecting surfaces included in the respective portions is such that the average value of the focal lengths of the left end portion is greater than that of > the central portion, and the average value of the focal lengths of the right end portion is greater than that of > the central portion. The aforementioned problems are solved by the arrangement wherein the focal, lengths of both end portion is made larger than that of the central portion whereby the horizontal flux distribution is spread to a predetermined angular range, as demanded, and the illuminance is obtained as desired.

DETAILED DESCRIPTION OF THE INVENTION

The present invention will now be described in detail by way of embodiments shown in the accompanying drawings.

Figure 1:
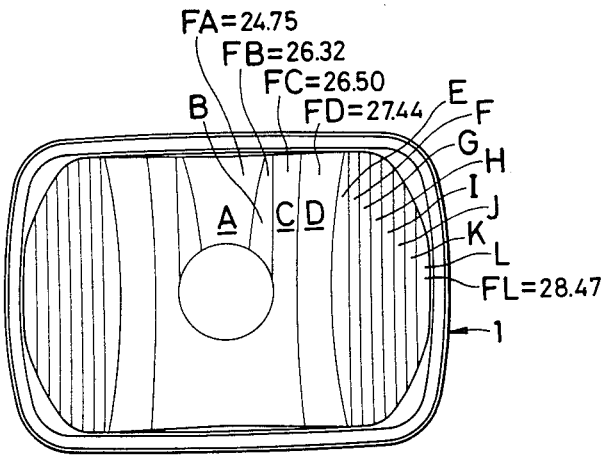
FIG. 1 is a front view showing a composite reflecting mirror for a headlamp according to the present invention.
Figure 2:
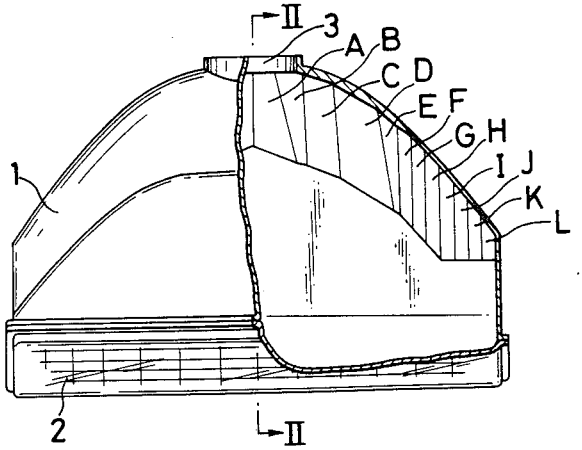
FIG. 2 is a top view showing a part of the headlamp partly cutaway using the composite reflecting mirror for a headlamp.
Figure 3:
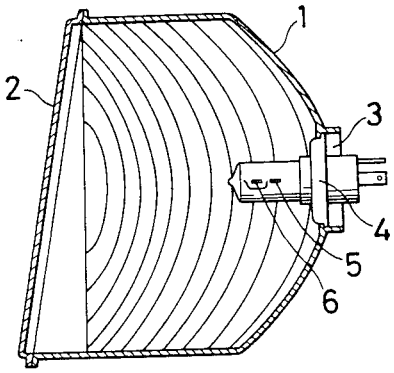
FIG. 3 is a sectional view taken on line II—II of FIG. 2.

Referring to FIGS. 1–3, reference numeral 1 designates a square-shaped composite reflecting mirror having a paraboloidal surface. The composite reflecting mirror 1 is used as a reflecting mirror for a headlamp, which has a front lens 2 mounted on the front side.

Figure 4:
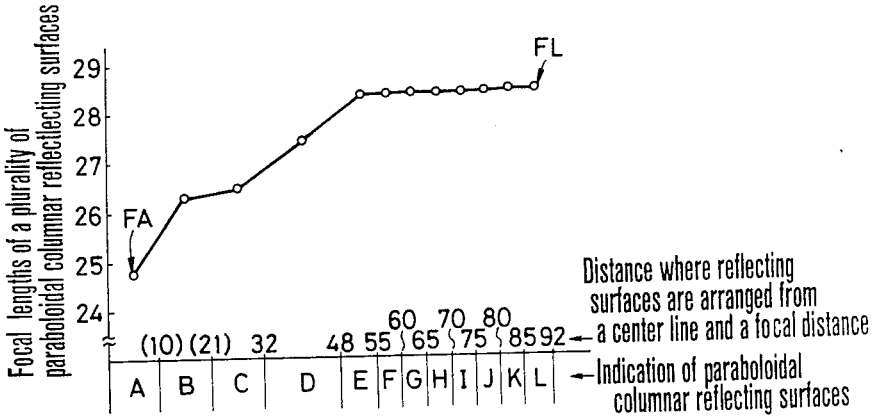
FIG. 4 is a graphic representation showing the distance where the reflecting surfaces are arranged from the center line and the focal distance.

The composite reflecting mirror 1 has the reflecting surface thereof divided into a plurality of paraboloidal columar reflecting portions in a longitudinal direction as viewed from the front, said divisions being formed symmetrically to the left and right around a mounting position 3 for a bulb or a light source. In the case of the illustrated embodiment, said divisions comprises 12 sections each to the left and right, which are indicated in FIGS. 1 and 2 as paraboloidal columnar reflecting surfaces A to L from the center toward the side end. These paraboloidal columnar reflecting surfaces A to L will be further described in detail. As will be also apparent from FIG. 1, the paraboloidal columnar reflecting surface (hereinafter referred to as the reflecting surface) is designed so that in the central portion, the width is wide while at in opposite ends, it is narrow, with different focal lengths FA to FL. For a better understanding of this phenomenon, FIG. 4 is provided in the form of a graph.

As for the respective reflecting surfaces A to L, the representative reflecting surfaces are shown in FIGS. 5 to 13, in which the distribution characteristic of pass-each other beams are arranged on the half of the right-hand side in the travelling direction of the vehicle. The light distribution characteristics of the reflecting surface A, reflecting surface B, reflecting surface C, reflecting surface D, reflecting surface E, reflecting surface F, reflecting surface H, reflecting surface J, and reflecting surface L are shown in FIG. 5, FIG. 6, FIG. 7, FIG. 8, FIG. 9, FIG. 10, FIG. 11, FIG. 12, and FIG. 13, respectively.

Figure 5:
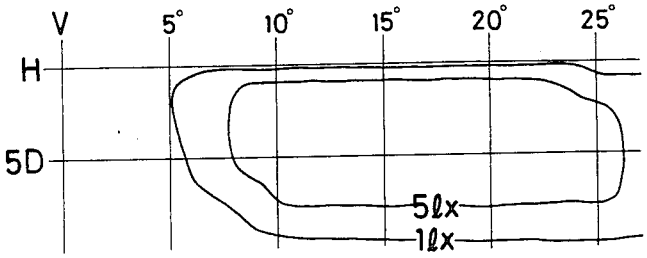
FIGS. 5 to 13 schematically illustrate the characteristic of light distribution by respective one surfaces of the divided reflecting surfaces, FIG. 14 being an explanatory view showing one example of a method for forming a reflecting surface, and FIG. 15 schematically illustrating one example of the characteristic of light distribution obtained by the composite reflecting mirror for a headlamp according to the present invention.
Figure 6:
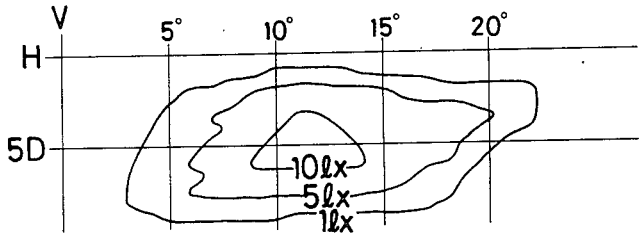
Figure 7:
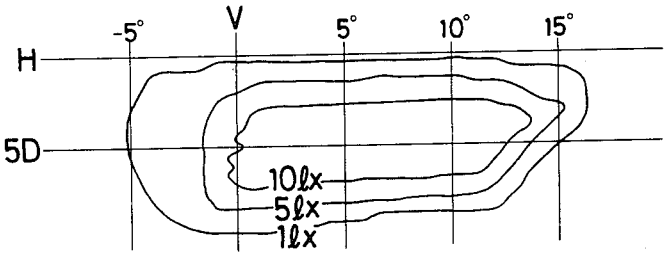
Figure 8:
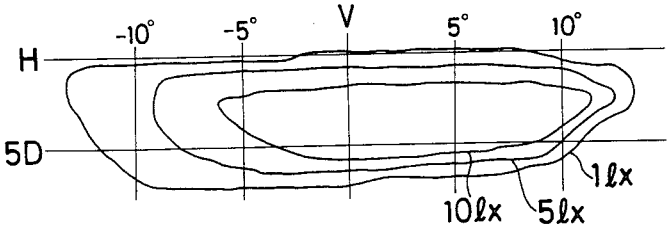
Figure 9:
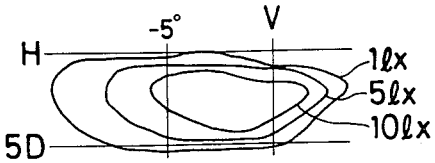
Figure 10:
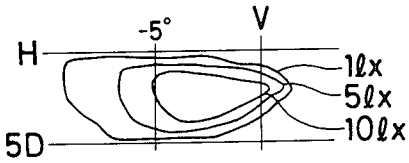
Figure 11:
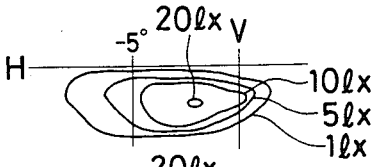
Figure 12:
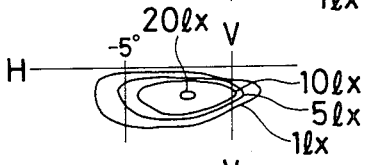
Figure 13:
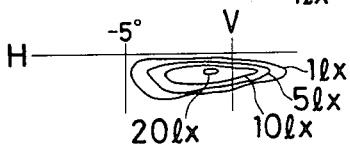
Figure 14:
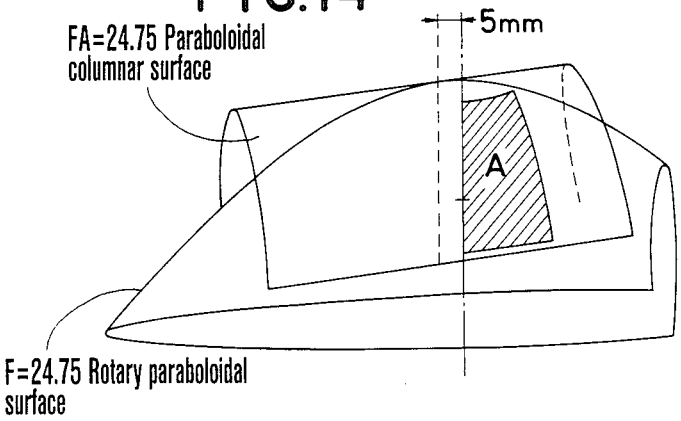
Figure 15:
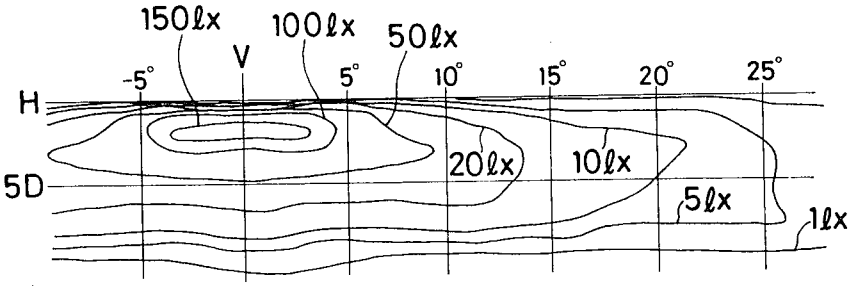
Figure 16:
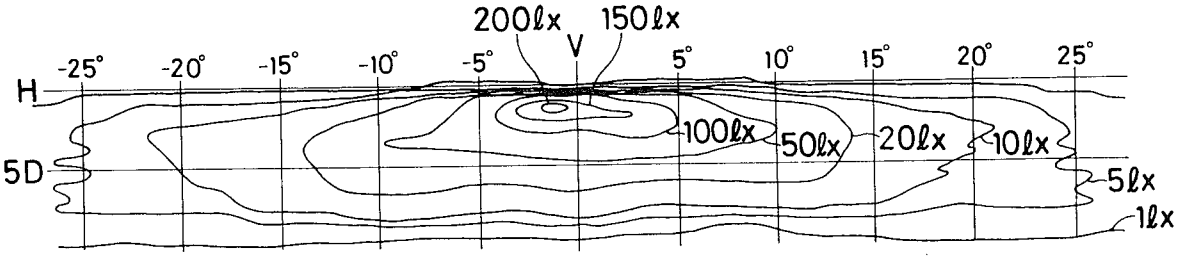
FIG. 16 schmatically illustrates one example of the characteristic of asymmetrical light distribution obtained by obliquely mounting an electric bulb on the composite reflecting mirror for a headlamp.
Figure 17:
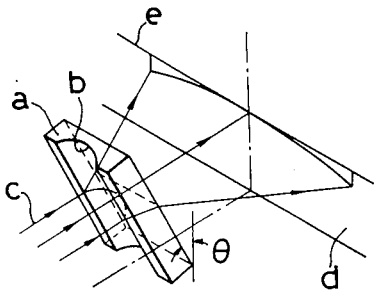
FIG.17 PRIOR ART
FIG. 17 is a schematic perspective view showing refraction of light in a partial cylindrical cut piece formed in the lens, which is an example for correction of luminuous fluxes in the prior art.
Figure 18:
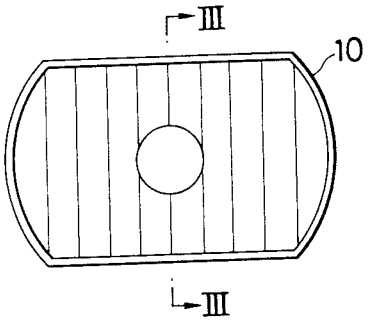
FIG.18 PRIOR ART
FIG. 18 is a front view of a prior art headlamp using the composite reflecting mirror according to the invention disclosed in Japanese patent publication No. 58-145002.
Figure 19:
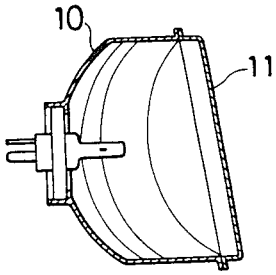
FIG.19 PRIOR ART
FIG. 19 is a sectional view taken on line III—III of FIG. 18.
Figure 20:
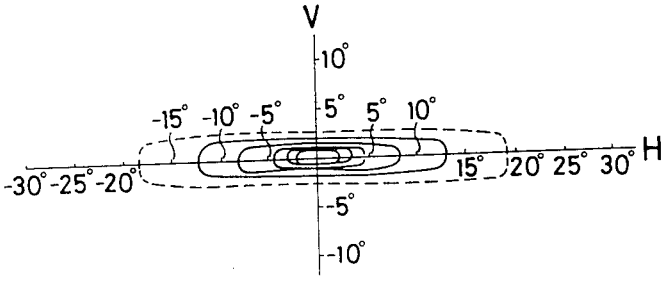
FIG.20 PRIOR ART
FIG. 20 illustrates a light distribution pattern of the reflecting mirror according to the prior art headlamp disclosed in Japanese patent publication No. 58-145002.
Figure 21:
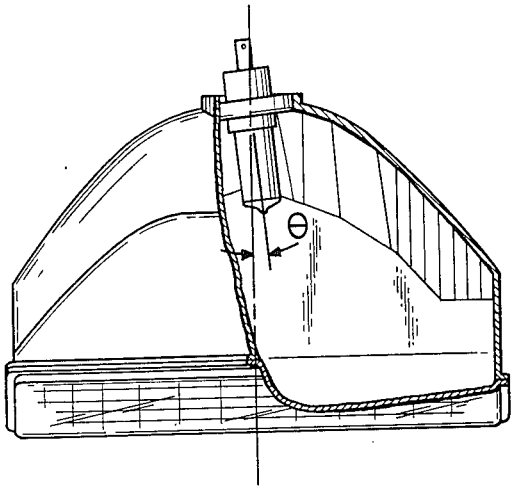
FIG. 21 is a top view of another embodiment showing a part of the headlamp partly cut away using the composite reflecting mirror for headlamp, with the bulb being mounted at an angle to the axis of the reflecting mirror.

Attention is now paid to the light distribution characteristic shown in FIG. 5 for the reflecting surface A. In the prior art, the light distribution characteristic is naturally in the vicinity of a vertical center line (hereinafter referred to as the V-line) of the light distribution pattern but in the illustrated embodiment of the present invention, the center of the light is deviated at 15° on the righthand side. This results from the fact that as shown in FIG. 14, the focal length of a rotary paraboloidal surface with which the reflecting surface A contacts is decreased and the position with which it contacts is 5 mm to the left. In a similar manner, the reflecting surface B in FIG. 6 and the reflecting surface C in FIG. 7 are also deviated on the right-hand side. The reflecting surface in FIG. 8 is formed substantially as in the prior art and therefore comprises the light distribution characteristic intersecting the V-line. The light distribution characteristics of the reflecting surfaces E to L shown in FIGS. 9 to 13 also intersect the V-line similarly to that of the reflecting surface shown in FIG. 8. However, as will be clear from FIG. 1, these reflecting surfaces are narrowed in width whereby the light distribution characteristic thereof is a spot-like characteristic. The light distribution characteristics of the righthand side reflecting surfaces as described above are naturally created symmetrically on the V-line also in the lefthand side reflecting surfaces. The synthesized or composite light distribution characteristic wherein all of these light distribution characteristics are added is shown in FIG. 15 (a part being omitted because of the light distribution symmetrical to left and right). From this, it can be easily understood that an ideal light distribution characteristic is obtained on the outside through the front lens 2. In short, the ideal synthesized or composite light distribution characteristic may be obtained by deviating the light distribution of the central reflecting surface having a suitable width and a relatively small focal length and making the reflecting surfaces on the opposite ends having a narrow width and a relatively large focal length, the spot-like light distribution characteristic which forms the so-called core of the light distribution. The light distribution characteristic symmetrical to the left and right has been described. This can be sufficiently used as a headlamp for a two-wheel vehicle. In addition, the aforesaid arrangement can of course be realized for one which employs the light distribution characteristic asymmetrical to the left and right, for example, such as a left traffic of a four-wheel vehicle by execution of a minor change in accordance with the method of the present invention as described above. Furthermore, needless to say, the asymmetrical light distribution characteristic may be obtained in the above-described reflecting mirror by inclining the bulb, as shown in FIG. 21. One example is shown in FIG. 16. According to this example, there is shown the light distribution characteristic obtained when a halogen-4 bulb is mounted inclined by approximately 2°. The position of the maximum illuminance for the pass-each other beams is one-sided toward the left through approximately 15° (switching of left and lower portions = traffic on leftside).

While the description has been made excluding the effect of the front lens 2, it is to be noted naturally that the effect of the prism cut of the front lens 2 may be combined. Thereby, it is possible to adjust the light distribution characteristic more closely to provide a geometrical effect.

It will be further noted that in setting the focal positions of the reflecting surfaces A to L, where a travelling beam filament and a pass-each other (i.e., passing) beam filament are deviated laterally, for example, such as a halogen-H bulb, the focal positions of the reflecting surfaces provided on the upper half surface in the central portion (the reflecting surfaces A and B in the present embodiment) may be set ahead, namely, so as to close toward the pass-each other beam filament whereby the light distribution characteristic by the pass-each other filament can be made so that sharper and upward light may not be radiated.

As described above, in the composite reflecting mirror according to the present invention, the focal lengths of the longitudinally juxtaposed paraboloidal columnar reflecting surfaces have been largely set at the opposite ends away from the light source, whereby the reflected light may be spread up to ±30° or so in a lateral direction. This spreading is the ideal spreading angle of the illuminated light as a headlamp, which rarely requires correction of luminous fluxes by the lens. An allowance of ±15° will suffice, thus exhibiting an excellent effect in that a troublesome lens cut may be eliminated.

Moreover, the focal lengths are largely set at the opposite ends, whereby the whole reflecting mirror may be formed into a laterally elongated reflecting surface which is high in utility of light and has a good reflecting efficiency. In addition, where the quantities of utilizing light are made to be the same as those of the conventional reflecting mirror having one and the same focal length, a reflecting mirror having less depth may be provided. Furthermore, the light distribution of the reflecting surface in the central portion having a suitable width and a relatively small focal length is one-sided and the reflecting surfaces at the opposite ends having a narrow width and a relatively large focal length are made to have the spot-like light distribution characteristic which forms the so-called core of the light distribution whereby the ideal light distribution pattern as a headlamp may be obtained. Since the correction of the spreading at the front lens is not needed, even if the angle of inclination of the front lens is greatly inclined in the range of 40° to 60°, the hanging phenomenon of light does not occur at all. An excellent effect may be exhibited which enables providing a headlamp which is hardly susceptible to air pressure.

What is claimed is:

1. A composite reflecting mirror for a headlamp with an inclined front lens, comprising:

a composite paraboloidal reflecting mirror having a plurality of adjacent paraboloidal columnar reflecting surfaces, said columnar reflecting surfaces having their respective focal points substantially on a line along an approximately horizontal axis of symmetry of the mirror; and a light source for projecting a light on said composite reflecting mirror;

said composite reflecting mirror being laterally substantially divided into at least a left end portion, a right end portion and a central portion arranged between said left and right end portions; and the average value of the focal lengths of said plurality of paraboloidal columnar reflecting surfaces included in said respective portions having a relationship such that the average value of the focal lengths of said left end portion is greater than that of said central portion, and the average value of the focal lengths of said right end portion is greater than that of said central portion.

2. The composite reflecting mirror for a headlamp according to claim 1, wherein:

the average value of any of said focal lengths of said left end portion, said right end portions and said central portion, is greater than 15 mm; and the difference of any of said average values of said focal lengths between said left end portion and said central portion and between said right end portion and said central portion is greater than 2.5 mm.

3. The composite reflecting mirror for a headlamp according to claim 1, wherein the focal positions of the plurality of paraboloidal columnar reflecting surfaces arranged on said central portion are arranged forward of a focal position of others of said paraboloidal columnar reflecting surfaces.

4. The composite reflecting mirror for a headlamp according to claim 1, wherein said light source comprises a bulb.

5. The composite reflecting mirror for a headlamp according to claim 4, wherein said bulb is mounted with its longitudinal axis inclined with respect to the axis of symmetry of said composite paraboloidal reflecting mirror.

6. The composite reflecting mirror for a headlamp according to claim 1, wherein said light source is mounted a predetermined distance in the horizontal direction from the focal point of said respective plurality of adjacent paraboloidal columnar reflecting surfaces of the composite paraboloidal reflecting mirror.

7. The composite reflecting mirror for a headlamp according to claim 1, further comprising a front lens coupled to the front end of said composite paraboloidal reflecting mirror, and through which said light emanated from said light source passes to the outside of said headlamp.

8. The composite reflecting mirror for a headlamp according to claim 7, wherein said front lens comprises a plurality of prism cuts therein.

9. The composite reflecting mirror for a headlamp according to claim 8, wherein said prism cuts comprise a plurality of substantially cylindrical concave curved surface portions formed in the surface of said lens which faces the interior of said headlamp.

10. The composite reflecting mirror for a headlamp according to claim 8, wherein said front lens is inclined at a predetermined angle to the vertical.

11. The composite reflecting mirror for a headlamp, according to claim 1 wherein said paraboloidal columnar reflecting surfaces are configured such that the light emanated from said headlamp has a spread angle of up to ±30° in a lateral direction.

* * * * *

UNITED STATES PATENT AND TRADEMARK OFFICE

CERTIFICATE OF CORRECTION

PATENT NO. : 4,779,179

DATED : Oct. 18, 1988

INVENTOR(S) : OYAMA et al

It is certified that error appears in the above-identified patent and that said Letters Patent is hereby corrected as shown below:

Column 3, line 53, "in" should be deleted.

Column 5, line 23, "± 15°" should be -- ± 5° --

Column 6, line 14 (Claim 2), "portions" should be -- portion --

Signed and Sealed this

Twenty-ninth Day of May, 1990

*Attest:*

HARRY F. MANBECK, JR.

*Attesting Officer*

*Commissioner of Patents and Trademarks*